United States Patent [19]

Yokoyama et al.

[11] Patent Number: 4,510,233

[45] Date of Patent: Apr. 9, 1985

[54] ANTISTATIC AGENT CONTAINING SILVER HALIDE PHOTOGRAPHIC LIGHT-SENSITIVE MATERIALS

[75] Inventors: Shigeki Yokoyama; Akira Hibino; Yukio Maekawa; Hiroshi Kawasaki, all of Kanagawa, Japan

[73] Assignee: Fuji Photo Film Co., Ltd., Kanagawa, Japan

[21] Appl. No.: 499,066

[22] Filed: May 27, 1983

[30] Foreign Application Priority Data

May 28, 1982 [JP] Japan ..... 57-90909

[51] Int. Cl.[3] ..... G03C 1/84

[52] U.S. Cl. ..... 430/527; 430/631

[58] Field of Search ..... 430/527, 531

[56] References Cited

U.S. PATENT DOCUMENTS

| | | | |
|---|---|---|---|
| 2,823,123 | 2/1958 | Knox et al. | 430/631 |
| 3,525,620 | 8/1970 | Nishio et al. | 430/631 |
| 3,850,641 | 11/1974 | Horigome et al. | 430/527 |
| 3,860,425 | 1/1975 | Ono et al. | 430/631 |
| 4,209,329 | 6/1980 | Lohner | 430/631 |
| 4,284,709 | 8/1981 | Tomka | 430/631 |

*Primary Examiner*—Jack P. Brammer

*Attorney, Agent, or Firm*—Sughrue, Mion, Zinn, Macpeak and Seas

[57] ABSTRACT

A silver halide photographic light-sensitive material comprised of a support base having thereon a silver halide emulsion layer and an antistatic layer. The antistatic layer contains a nonionic surface active agent having two polyoxyethylene chains in a molecule, the agent being represented by the formula (I):

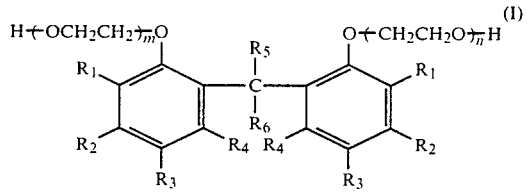

(I)

wherein $R_1$ and $R_3$ each represents a substituted or non-substituted alkyl, aryl, alkoxy, aryloxy, acyl, amido, sulfonamido, carbamoyl or sulfamoyl group, or a halogen atom, $R_2$ and $R_4$ each represents a hydrogen atom, a substituted or nonsubstituted alkyl, aryl, alkoxy, aryloxy, acyl, amido, sulfonamido, carbamoyl or sulfamoyl group, or a halogen atom, $R_5$ and $R_6$ each represents a hydrogen atom, or a substituted or nonsubstituted alkyl or aryl group, wherein the sum total of carbon atoms in $R_5$ and $R_6$ is 2 or more, or $R_5$ and $R_6$ may form a ring by linking with each other, and m and n independently each represents an average degree of polymerization of ethylene oxide which is 2 to 40. The antistatic layer provides a photographic material which has excellent antistatic effects without causing undesirable effects on the photographic properties of the material. The antistatic layer does not cause screen contamination and the antistatic effects do not deteriorate with the passage of time. Particularly good results are obtained with silver halide light-sensitive materials utilized with high speed processing at a high temperature especially when the materials are of high sensitivity.

13 Claims, No Drawings

ANTISTATIC AGENT CONTAINING SILVER HALIDE PHOTOGRAPHIC LIGHT-SENSITIVE MATERIALS

FIELD OF THE INVENTION

The present invention relates to silver halide photographic light-sensitive materials (hereinafter referred to as "photographic light-sensitive materials") and particularly to photographic light-sensitive materials having an improved antistatic property.

BACKGROUND OF THE INVENTION

Since photographic light-sensitive materials are generally composed of a base having an electrically insulating property and photographic layers, static charges are often accumulated when producing the photographic light-sensitive materials or using them by subjecting to contact friction between surfaces of the same or different kinds of material or separation thereof. The accumulated static charges cause various troubles. The most serious trouble is that the light-sensitive emulsion layer is exposed to light by discharge of accumulated static charges prior to development. This causes dot spots or resinous or feathery linear spots upon development of the photographic film. This phenomenon forms the so-called static mark, by which the commercial value of the photographic films is remarkably damaged or, sometimes, completely lost. For example, it is easily understood that static marks result in a dangerous judgment when they appear on medical or industrial X-ray films. Since this phenomenon becomes evident for the first time by carrying out development, it is a very troublesome problem. Further, the accumulated static changes causes secondary troubles, for example, dust may adhere to the surface of the films or uniform application of photographic layers to the films cannot be carried out.

Such static charges are often accumulated when producing photographic light-sensitive materials or using them, as described above. For example, during production, they are generated by contact friction between the photographic film and a roll or by separation of the base face and the emulsion face when winding or rewinding the photographic film. Further, they are generated in an automatic photographing apparatus by contact of the X-ray film with machine parts or with fluorescent sensitizing paper or separation therefrom. In addition, they are generated in contact with packing materials, etc. Generation of the static marks induced by accumulation of such static charges becomes rather substantial with increases in the sensitivity of photographic light-sensitive materials and increases in the processing rate. Particularly, in recent years, static marks are more easily generated, because the photographic light-sensitive materials have come to have high sensitivity and there are many opportunities for subjecting the materials to severe handling such as high speed application, high speed photographing or high speed automatic processing, etc.

In order to aid in eliminating the problems created by static electricity, antistatic agents are preferably added to the photographic light-sensitive materials. Antistatic agents utilized in the photographic light-sensitive materials must have different characteristics than antistatic agents conventionally used in other fields because there are various restrictions which are characteristic to photographic light-sensitive materials. Antistatic agents which can be utilized in photographic light-sensitive materials must not only have excellent antistatic properties but they must not have bad influences upon photographic properties such as sensitivity, fog, granularity or sharpness. Further, they must not have bad influences on the film strength of the photographic light-sensitive materials (namely, scratches are not easily formed by friction or scratching), they must not have bad influences on anti-adhesive properties (namely, the surface of the photographic light-sensitive material does not easily adhere to the surface of the photographic light-sensitive material or other materials), they must not promote fatigue of processing solutions for the photographic light-sensitive materials, or they must not reduce the adhesive strength between layers of the photographic light-sensitive materials. Accordingly, the application of antistatic agents to photographic light-sensitive materials is subjected to a number of restrictions.

One method of removing troubles due to static electricity comprises increasing the electrical conductivity of the surface of the photographic light-sensitive materials in order to disperse static charges in a short time prior and thus discharge accumulated charges.

Thus, methods of increasing electrical conductivity of the base in the photographic light-sensitive materials or various kinds of surface coating layer thereof have been proposed. Attempts have been made at utilizing various hygroscopic substances and water-soluble inorganic salts, certain kinds of surface active agents and polymers. For example, the use of polymers described in U.S. Pat. Nos. 2,882,157, 2,972,535, 3,062,785, 3,262,807, 3,514,291, 3,615,531, 3,753,716 and 3,938,999, etc., surface active agents described in U.S. Pat. Nos. 2,982,651, 3,428,456, 3,457,076, 3,454,625, 3,552,972 and 3,655,387, etc., and metal oxides and colloidal silica described in U.S. Pat. Nos. 3,062,700, 3,245,833 and 3,525,621, etc., are known.

However, it is very difficult to apply these substances to photographic light-sensitive materials, because they are particularly suited for one kind of film base or photographic composition. Accordingly, they produce good results when used with a specified film base or photographic emulsion or other photographic elements. However, they are useless for preventing static charges when used with different film bases and photographic elements, or they have an excellent antistatic property but have a bad influence upon photographic properties such as sensitivity of photographic emulsions, fog, granularity or sharpness, etc., or they have an excellent antistatic property just after production but the antistatic property deteriorates with the passage of time.

Nonionic surface active agents having one polyoxyethylene chain in a molecule are described in British Pat. No. 861,134 and German Pat. No. 1,422,309. These agents have excellent antistatic properties.

However, when they are applied to photographic light-sensitive materials the following problems occur: (1) they remarkably deteriorate sensitivity, (2) since their antistatic properties deteriorate with the passage of time, though they have good antistatic properties just after production, the antistatic properties of products become inferior when the products are used, and (3) when applied to X-ray sensitive materials, dotted or mesh-like uneven density (which is called "screen contamination") is formed on the sensitive materials after development, because the sensitive materials contact with sensitizing paper (fluorescent screen) when taking photographs. Accordingly, the value of the products is remarkably reduced and, sometimes, completely lost.

On the other hand, U.S. Pat. No. 3,850,641 has disclosed a method in which an ethylene oxide addition polymer of phenol-formaldehyde resin is applied as an antistatic agent for photographic light-sensitive materials. This polymer is synthesized by carrying out a polycondensation reaction of phenol derivatives and formaldehyde to form the so-called phenol-formaldehyde resin, and thereafter carrying out addition polymerization of ethylene oxide.

It is inevitable that the phenol-formaldehyde resin synthesized as described above is contaminated by unreacted phenol derivatives. Contamination of the unreacted phenol derivatives increases when synthesizing a resin having a lower degree of polymerization. Further, the process for removing unreacted phenol derivatives in the resin is very inconvenient. Even if the removal operation is repeated, it is very difficult to completely remove unreacted phenol derivatives. Accordingly, for practical purposes it is impossible to industrially produce phenol-formaldehyde resin which does not contain any unreacted phenol derivatives. In an ethylene oxide addition polymer of the phenol-formaldehyde resin contaminated with unreacted phenol derivatives, it is impossible to avoid various problems similar to those which occur with nonionic surface active agents having one polyoxyethylene chain in the molecule as described in British Pat. No. 861,134 and German Pat. No. 1,422,803. The problem occurs because these agents contain molecules having one polyoxyethylene chain in the molecule originated in the unreacted phenol derivatives in addition to molecules having many polyoxyethylene chains in the molecule.

Further, it is very difficult to obtain phenol-formaldehyde resin having a definite composition, because not only the content of unreacted phenol derivatives but also the average degree of polymerization or the distribution of degree of polymerization varies due to slight variations in conditions for synthesizing the resin. In addition, it is easily understood that, when the ethylene oxide addition polymer of phenol-formaldehyde resin is produced by addition polymerization of ethylene oxide, it is very difficult to control the polymer so as to have a definite composition to form an antistatic layer having a definite quality.

Moreover, other phenol resins such as phenol-acetaldehyde resin or phenol-furfural resin, etc., have similar problems.

SUMMARY OF THE INVENTION

A first object of the present invention is to provide antistatic photographic light-sensitive materials which do no cause undesirable effects on photographic properties, such as no desensitization, etc.

A second object of the present invention is to provide antistatic photographic light-sensitive materials which do not cause screen contamination.

A third object of the present invention is to provide antistatic photographic light-sensitive materials having antistatic properties which do not change after production with the passage of time.

A fourth object of the present invention is to provide antistatic photographic light-sensitive materials having stabilized quality in which the antistatic properties hardly change due to variations in conditions for producing the antistatic agent.

As a result of earnest studies relating to antistatic agents which do not contain compounds having one polyoxyethylene chain in the molecule which have undesirable influences on the properties of photographic light-sensitive materials, we have found that photographic light-sensitive materials having almost no undesirable influences are surprisingly obtained when a surface active agent having two polyoxyethylene chains in the molecule represented by the following formula (I) is added to an antistatic layer in the photographic light-sensitive materials.

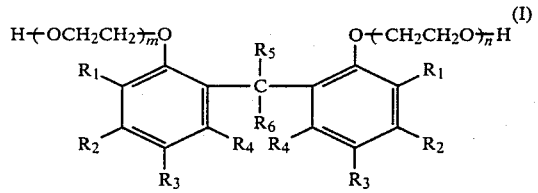

In the formula (I), $R_1$ and $R_3$ each represents a substituted or nonsubstituted alkyl, aryl, alkoxy, aryloxy, acyl, amido, sulfonamido, carbamoyl or sulfamoyl group, or a halogen atom.

$R_2$ and $R_4$ each represents a hydrogen atom, a substituted or nonsubstituted alkyl, aryl, alkoxy, aryloxy, acyl, amido, sulfonamido, carbamoyl or sulfamoyl group, or a halogen atom.

$R_5$ and $R_6$ each represents a hydrogen atom, or a substituted or nonsubstituted alkyl or aryl group, wherein the sum total of carbon atoms in $R_5$ and $R_6$ is 2 or more. Further, $R_5$ and $R_6$ may form a ring by linking with each other. m and n each represents an average degree of polymerization of ethylene oxide, which is 2 to 40. m and n may be identical or different from each other.

DETAILED DESCRIPTION OF THE INVENTION

In the following, preferred embodiments of the present invention are illustrated.

$R_1$, $R_2$, $R_3$ and $R_4$ each represents a substituted or nonsubstituted alkyl group having 1 to 20 carbon atoms such as a methyl group, an ethyl group, an i-propyl group, a t-butyl group, a t-amyl group, a t-hexyl group, a t-octyl group, a nonyl group, a decyl group, a dodecyl group, a trichloromethyl group, a tribromomethyl group, a 1-phenylethyl group or a 2-phenyl-2-propyl group, etc., a substituted or nonsubstituted aryl group such as a phenyl group or a p-chlorophenyl group, etc., a substituted or nonsubstituted alkoxy or aryloxy group represented by $—OR_7$ (wherein $R_7$ represents a substituted or nonsubstituted alkyl or aryl group having 1 to 20 carbon atoms; the same meaning hereinafter), a halogen atom such as a chlorine atom or a bromine atom, etc., a substituted or nonsubstituted acyl group represented by $—COR_7$, a substituted or nonsubstituted amido group represented by $—NR_8COR_7$ (wherein $R_8$ represents a hydrogen atom or an alkyl group having 1 to 20 carbon atoms; the same meaning hereinafter), a substituted or nonsubstituted sulfonamido group represented by $—NR_8SO_2R_7$, a carbamoyl group represented by

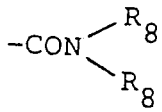

(II)

or a sulfamoyl group represented by

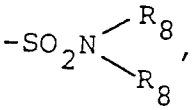

(III)

and $R_2$ and $R_4$ each may be a hydrogen atom.

Among them, it is preferred that $R_1$ and $R_3$ each represents an alkyl group having 1 to 12 carbon atoms or a halogen atom. It is particularly preferred that $R_1$ represents a bulky tertiary alkyl group having up to 12 carbon atoms such as a t-butyl group, a t-amyl group, a t-hexyl group or a t-octyl group, etc. It is preferred that $R_2$ and $R_4$ each represents a hydrogen atom. Namely, compounds represented by the formula (I) synthesized from 2,4-disubstituted phenols are particularly preferred.

$R_5$ and $R_6$ each represents a hydrogen atom, a substituted or nonsubstituted alkyl group such as a methyl group, an ethyl group, an n-propyl group, an i-propyl group, an n-heptyl group, a 1-ethyl-n-amyl group, an n-undecyl group, a trichloromethyl group or a tribromomethyl group, etc., or a substituted or nonsubstituted aryl group such as a phenyl group, a naphthyl group, a p-chlorophenyl group, a p-methoxyphenyl group or an m-nitrophenyl group, etc. The sum total of carbon atoms in $R_5$ and $R_6$ is 2 or more. Further, $R_5$ and $R_6$ may form a ring by linking with each other. This ring includes, for example, a cyclohexane ring. Among them, it is preferred that $R_5$ and $R_6$ each represents a hydrogen atom, an alkyl group having 1 to 8 carbon atoms or a phenyl group. It is particularly preferred that $R_6$ is a hydrogen atom and $R_5$ is an alkyl group having 2 to 8 carbon atoms (such as an ethyl group, an n-propyl group and an i-propyl group) or a phenyl group, and that $R_6$ is an alkyl group having 1 to 8 carbon atoms or a phenyl group and $R_5$ is an alkyl group having 1 to 8 carbon atoms or a phenyl group.

m and n each represents an average degree of polymerization of the oxyethylene unit: $-(OCH_2CH_2)-$, which is 2 to 40, and, preferably, 5 to 30. m and n may be identical or may be different from each other.

The compounds of the present invention can be prepared by carrying out addition polymerization of ethylene oxide with bisphenol represented by the following formula (II).

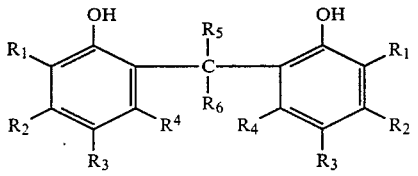

(II)

wherein $R_1$, $R_2$, $R_3$, $R_4$, $R_5$ and $R_6$ each represents the same meaning as described above.

Synthesis of bisphenols represented by the formula (II) is not restricted, but the following two processes are generally utilized.

(1) A process which comprises reacting a phenol derivative represented by the formula (III) with aldehyde represented by the formula (IV) in the presence of an acid catalyst by the same manner as the process described in *Journal of the American Chemical Society,* Vol. 74, pages 3410 to 3411 (1952).

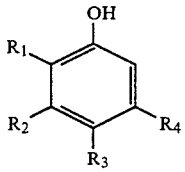

(III)

wherein $R_1$, $R_2$, $R_3$ and $R_4$ each represents the same meaning as described above.

$R_5$—CHO (IV)

wherein $R_5$ represents the same meaning as described above, but the number of carbon atoms in $R_5$ is 2 or more.

(2) A process which comprises reacting a phenol derivative represented by the formula (III) with ketone represented by the formula (V) by the same manner as the process described in U.S. Pat. No. 2,468,982.

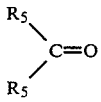

(V)

wherein $R_5$ and $R_6$ each represents the same meaning as described above.

The phenol-formaldehyde resin is a mixture of polymers having various degrees of polymerization as described in Kagakù Daijiten, edited by *Kagaku Daijiten* Editorial Committee, Vol. 7, pages 731 to 733 (published by Kyorsitsu Shuppan Co., 1964), *Gosei Jushi Kagaku,* written by Minoru Imoto, page 193 (published by Zoshindo, 1949) and *Phenol Resin,* written by Shinichi Murakami, pages 22 to 23 (published by Nikkan Kogyo Shinbunsha, 1961).

The phenol-formaldehyde resin is an amorphous vitric substance upon which it is very difficult to carry out a purification operation for removing unreacted phenol derivatives on an industrial scale. Thus, it is substantially impossible to obtain phenol-formaldehyde resins which do not contain any unreacted phenol derivatives.

On the other hand, bisphenol represented by the formula (II) having good quality which shows a sharp melting point or boiling point can be easily obtained by a conventional operation utilized in chemical industries, such as recrystallization or distillation, because it is a single compound.

In order to obtain compounds having two polyoxyethylene chains in the molecule represented by the formula (I) from the bisphenol represented by the formula (II) synthesized as described above, addition polymerization of ethylene oxide is carried out. The process used generally comprises blowing an ethylene oxide gas into the bisphenol of the formula (II) in the presence of a base such as sodium hydroxide or potassium hydroxide, etc., as described in *Shin Kaimenkasseizai,* written by Hiroshi Horiguchi, pages 644 to 670 (published by Sankyo Shuppan Co., 1975).

Examples of nonionic surface active agents having two polyoxyethylene chains in the molecule of the present invention represented by the formula (I) are shown in the following.

Compound 1

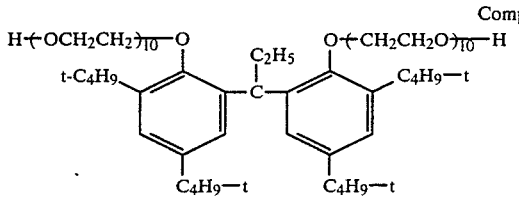

Compound 2

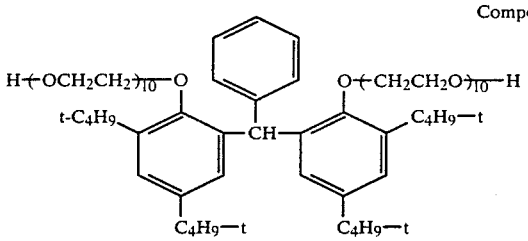

Compound 3

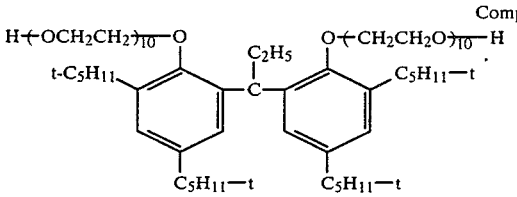

Compound 4

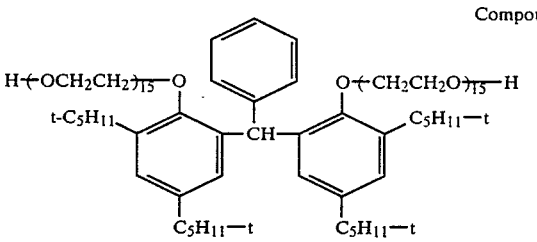

Compound 5

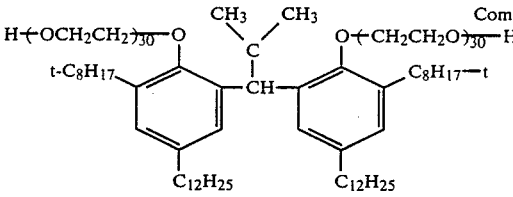

Compound 6

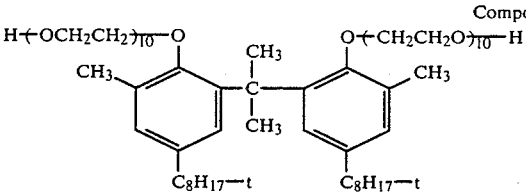

-continued

Compound 7

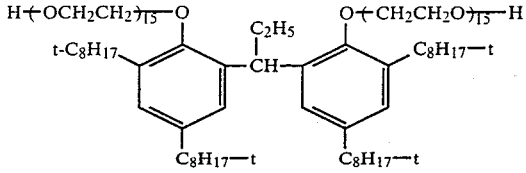

Compound 8

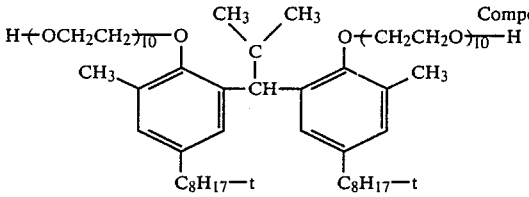

Compound 9

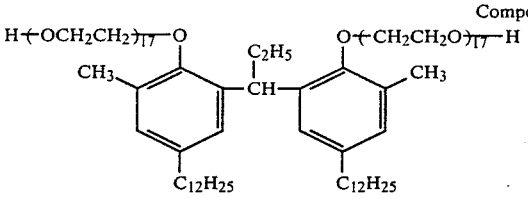

Compound 10

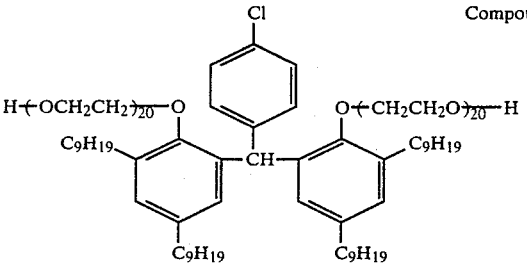

Compound 11

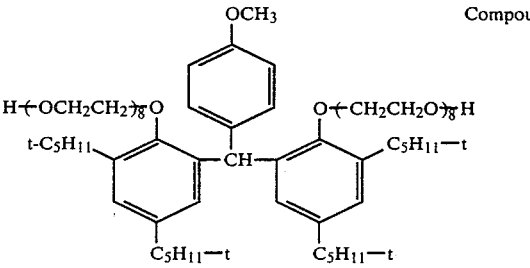

Compound 12

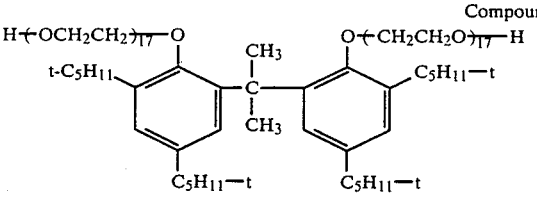

-continued

Compound 13

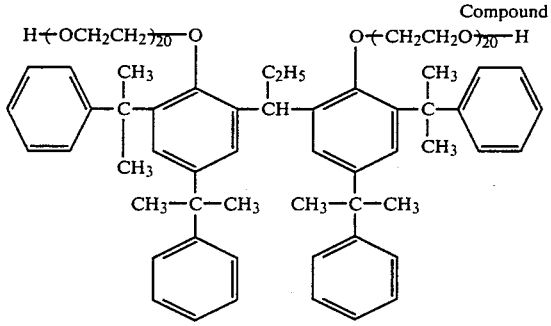

Compound 14

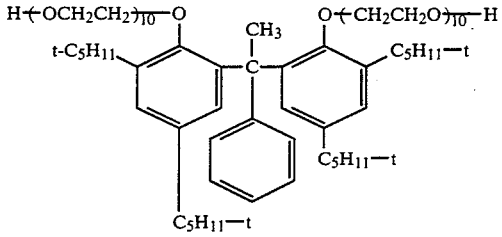

Compound 15

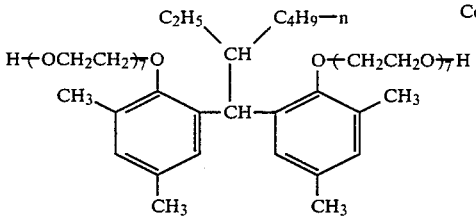

Compound 16

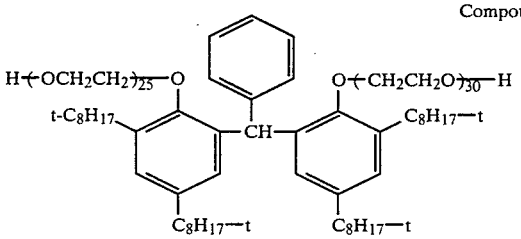

Compound 17

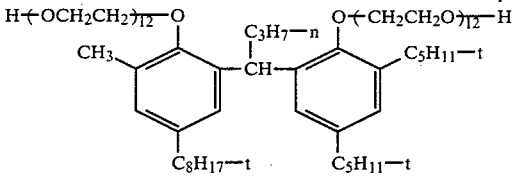

Compound 18

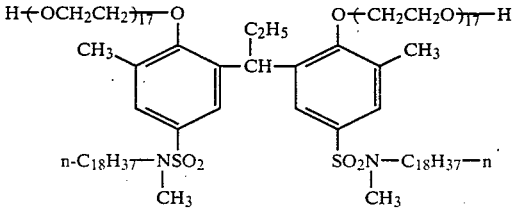

-continued

Compound 19

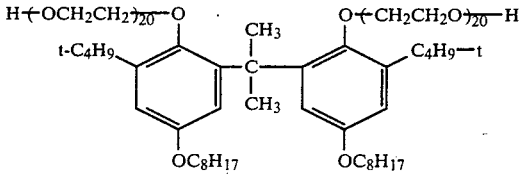

Compound 20

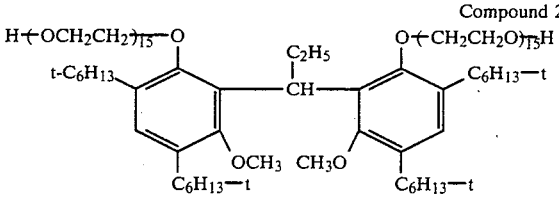

Compound 21

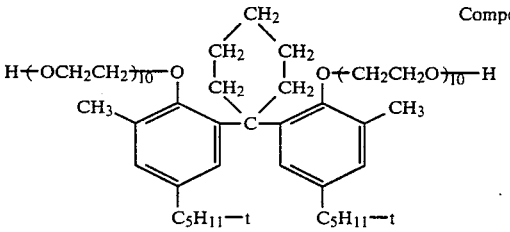

Compound 22

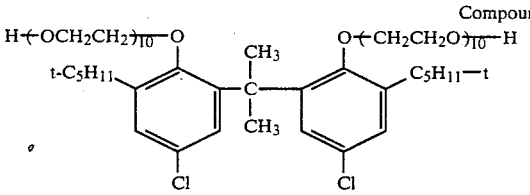

Compounds 1, 2, 3, 4, 5, 7, 11, 12, 13, 14, 16, 19, 20 and 22 are particularly preferred.

In the following, examples for synthesizing the nonionic surface active agents having two polyoxyethylene chains in the molecule of the present invention are described.

SYNTHESIS EXAMPLE 1

Synthesis of Compound 1

In a 500 ml three-neck flask equipped with a stirrer, a thermometer and a calcium chloride drying tube, 82.4 g (0.4 mol) of 2,4-di-t-butylphenol and 100 ml of glacial acetic acid were placed, and 12 ml of concentrated sulfuric acid was then added slowly. After being cooled to 0° to 3° C., 14 g (0.24 mol) of propionaldehyde was added dropwise with stirring. After addition, stirring was continued at 0° to 3° C. for 5 hours, and thereafter the mixture was allowed to stand at room temperature for 2 days. Separated crystals were filtered out, washed with water and recrystallized from 200 ml of ethanol/water (5/1 by vol.) to obtain 30 g of white crystals of 1,1-bis(2-hydroxy-3,5-di-t-butylphenyl)propane. Yield: 34%. Melting point: 144°-145.5° C.

In a 200 ml three-neck flask equipped with a stirrer and a reflux condenser, 21.9 g (0.05 mol) of 1,1-bis(2-hydroxy-3,5-di-t-butylphenyl)propane, 13 g of xylene and 0.3 g of potassium hydroxide were placed, and an ethylene oxide gas was bubbled into the mixture with stirring at 140° C. Stirring and heating were continued to polymerize ethylene oxide till the weight of the reacting solution increased 44 g (corresponding to 1 mol of ethylene oxide). After being cooled to room temperature, 100 ml of methanol was added, and the mixture was neutralized with hydrochloric acid and subjected to decolorization treatment with decolorizing carbon. After the solvent was distilled off, 100 ml of ethyl acetate was added. After insoluble salts were removed by filtration, the solvent was distilled off again to obtain 64 g of light yellow waxy Compound 1.

SYNTHESIS EXAMPLE 2

Synthesis of Compound 4

In a 200 ml three-neck flask equipped with a stirrer, a thermometer and a water separater, 46.8 g (0.2 mol) of 2,4-di-t-amylphenol, 50 ml of tuluene, 0.38 g (2 millimols) of p-toluenesulfonic acid monohydrate and 15.9 g (0.15 mol) of benzaldehyde were placed, and the mixture was refluxed under a reduced pressure with stirring at 65° C. to remove formed water. After the reaction, 50 ml of ethyl acetate was added and the mixture was washed with an aqueous solution of sodium hydrogen carbonate and thereafter with water. After being dried with anhydrous sodium sulfate, the solvent was distilled off. Recrystallization was carried out from 100 ml of methanol/water (10/1 by vol.) to obtain 25 g of white crystals of bis(2-hydroxy-3,5-di-t-amylphenyl)-phenylmethane. Yield: 68%. Melting point: 78.5° to 79.5° C.

Thereafter, addition polymerization of ethylene oxide was carried out by the same manner as in Synthesis Example 1 to obtain 91 g of light yellow waxy Compound 4 from 27.8 g of bis(2-hydroxy-3,5-di-t-amylphenyl)phenylmethane.

The amount of the nonionic surface active agent having two polyoxyethylene chains in the molecule of the present invention represented by the formula (I) varies according to the kind of the photographic light-sensitive material to be used or the coating process, etc., but it is generally 5 to 500 mg, particularly preferably 20 to 200 mg, per 1 $m^2$ of the photographic light-sensitive material.

In order to apply the nonionic surface active agent having two polyoxyethylene chains in the molecule of the present invention represented by the formula (I) to layers in the photographic light-sensitive materials, it is dissolved in water or an organic solvent such as methanol, ethanol or acetone, etc., or a solvent mixture composed of water and said organic solvent, and the resulting solution is then introduced into a light-sensitive emulsion layer or a light-insensitive auxiliary layer (for example, a backing layer, an antihalation layer, an intermediate layer or a protective layer, etc.) on the base or the solution is applied to the surface of the base by spraying, coating or dipping, followed by drying. In this case, two or more nonionic surface active agents having two polyoxyethylene chains in the molecule of the present invention may be used as a mixture.

Further, the nonionic surface active agent of the present invention may be used together with a binder such as gelatin, polyvinyl alcohol, cellulose acetate, cellulose acetate phthalate, polyvinyl formal or polyvinyl butyral, etc., to form an antistatic layer.

In the layer containing the nonionic surface active agent having two polyoxyethylene chains in the molecule of the present invention represented by the formula (I) or other layers, other antistatic agents can be used together, by which a more suitable antistatic effect can be obtained. Examples of such antistatic agents include polymers as described in U.S. Pat. Nos. 2,882,157, 2,972,535, 3,062,785, 3,262,807, 3,514,291, 3,615,531, 3,753,716, 3,938,999, 4,070,180 and 4,147,550, German Patent 2,800,466, and Japanese Patent Application (OPI) Nos. 91165/73, 94433/73, 46733/74, 54672/75, 94053/75 and 129520/77 (the term "OPI" as used herein refers to a "published unexamined Japanese patent application"); surface active agents as described in U.S. Pat. Nos. 2,982,651, 3,428,456, 3,457,076, 3,454,625, 3,552,972 and 3,655,387, etc.; metal oxides and colloidal silica, etc., as described in U.S. Pat. Nos. 3,062,700, 3,245,833 and 3,525,621, etc.; and the so-called matting agents such as barium sulfate, strontium sulfate, polymethyl methacrylate, methyl methacrylate-methacrylic acid copolymer, colloidal silica or powdery silica, etc.

Further, polyol compounds as described in Japanese Patent Application (OPI) No. 89626/79 such as ethylene glycol, propylene glycol or 1,1,1-trimethylolpropane, etc., may be added to the layer containing the nonionic surface active agent having two polyoxyethylene chains in the molecule of the present invention represented by the formula (I) or other layers, by which a more suitable antistatic effect can be obtained.

Examples of the layer containing the nonionic surface active agent having two polyoxyethylene chains in the molecule of the present invention include an emulsion layer, a subbing layer provided on the same side of the emulsion layer, an intermediate layer, a surface protective layer, an overcoat layer, a back layer provided on the reverse side of the emulsion layer. Among them, surface layers (i.e., outermost layer) such as the surface protective layer, the overcoat layer and the back layer, etc., are preferred.

Examples of the base capable of applying the nonionic surface active agent having two polyoxyethylene chains in the molecule of the present invention include films of polyolefin such as polyethylene, polystyrene, cellulose derivatives such as cellulose acetate and polyesters such as polyethylene terephthalate, etc., baryta paper, synthetic paper, and paper both sides of which are covered with the above-described polymer film, and analogous bases.

An antihalation layer may be formed on the base used in the present invention. For this purpose, it is possible to use carbon black or various dyes, for example, oxonol dyes, azo dyes, arylidene dyes, styryl dyes, anthraquinone dyes, merocyanine dyes and tri-(or di-)arylmethane dyes, etc. Examples of binders used for the carbon black or dyes include cellulose acetate (di- or mono-), polyvinyl alcohol, polyvinyl butyral, polyvinyl acetal, polyvinyl formal, polymethacrylic acid ester, polyacrylic acid ester, polystyrene, styrene-maleic acid anhydride copolymer, polyvinyl acetate, vinyl acetate-maleic acid anhydride copolymer, methyl vinyl ether-maleic acid anhydride copolymer, polyvinylidene chloride and derivatives of them.

Photographic light-sensitive materials used with the present invention include conventional black-and-white silver halide light-sensitive materials (for example, black-and-white light-sensitive materials for photographing, black-and-white light-sensitive materials for X-rays and black-and-white light-sensitive materials for printing, etc.), conventional multilayer color light-sensitive materials (for example, color reversal films, color negative films and color positive films, etc.) and various light-sensitive materials. The effect of the invention is particularly strong with silver halide light-sensitive materials for high speed processing at a high temperature and silver halide light-sensitive materials having high sensitivity.

In the following, photographic layers in the silver halide light-sensitive materials according to the present invention are illustrated in brief.

Binders used in the photographic layers include proteins such as gelatin, or casein, etc., cellulose compounds such as carboxymethyl cellulose or hydroxyethyl cellulose, etc., saccharose derivatives such as agar, sodium alginate or starch derivatives, etc., synthetic hydrophilic colloids such as polyvinyl alcohol, poly-N-vinylpyrrolidone, polyacrylic acid copolymer, polyacrylamide or derivatives of them or partially hydrolyzed products of them.

Gelatin used here means the so-called lime-treated gelatin, acid-treated gelatin and enzyme-treated gelatin.

All or part of the gelatin can be replaced by synthetic high molecular substances. Further, it may be replaced by so-called gelatin derivatives, namely, those which are prepared by modifying functional groups in the molecule such as amino groups, imino groups, hydroxy groups or carboxyl groups with a reagent having a group capable of reacting with them, or graft polymers of gelatin wherein molecular chains of high polymer are bonded thereto.

The kind of silver halide, the process for production thereof, the method of chemical sensitization, antifogging agents, stabilizers, hardeners, plasticizers, lubricants, coating assistants, matting agents, whitening agents, spectral sensitizers, dyes and color couplers, etc., used in silver halide emulsion layers and the surface protective layers, etc., in the photographic light-sensitive materials of the present invention are not particularly restricted. Information relating to these matters is described in, for example, *Product Licensing*, Vol. 92, pages 107 to 110 (December, 1971) and *Research Disclosure*, Vol. 176, pages 22 to 31 (December, 1978).

Particularly, there are a number of useful antifogging agents and stabilizers such as heterocyclic compounds including 4-hydroxy-6-methyl-1,3,3a,7-tetraazaindene-3-methylbenzothiazole and 1-phenyl-5-mercaptotetrazole, mercury containing compounds, mercapto compounds or metal salts, etc. Examples of the hardeners include aldehyde compounds such as mucochloric acid, mucobromic acid, mucophenoxychloric acid, mucophenoxybromic acid, formaldehyde, dimethylol urea, trimethylol melamine, glyoxal, monomethyl glyoxal, 2,3-dihydroxy-1,4-dioxane, 2,3-dihydroxy-5-methyl-1,4-dioxane, succinaldehyde, 2,5-dimethoxytetrahydrofuran or glutaraldehyde; active vinyl compounds such as divinyl sulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, bis(vinylsulfonylmethyl)ether, 1,3-bis(vinylsulfonylmethyl)propanol-2 or bis(α-vinylsulfonylacetamido)ethane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine or N,N'-bis(2-chloroethylcarbamoyl)piperazine; epoxy compounds such as bis(2,3-epoxypropyl)methylpropyl ammonium p-toluenesulfonate, 1,4-bis(2',3'-epoxypropyloxy)butane, 1,3,5-triglycidylisocyanurate or 1,3-diglycidyl-5-(γ-acetoxy-β-oxypropyl)isocyanurate; ethyleneimine compounds such as 2,4,6-triethyleneimino-s-triazine, 1,6-hexamethylene-N,N'-bisethylene urea or bis-β-ethyleneiminoethyl thioether; methanesulfonic acid esters such as 1,2-di(methanesulfonyloxy)ethane, 1,4-di(methanesulfonyloxy)butane or 1,5-di(methanesulfonyloxy)pentane; carbodiimide compounds; isoxazole compounds; and inorganic compounds such as chromium alum.

To the photographic layers in the present invention, known surface active agents may be added. Examples of useful surface active agents include natural surface active agents such as saponin, etc.; nonionic surface active agents such as glycerin type agents or glycidol type agents; cationic surface active agents such as higher alkylamines, quaternary ammonium salts, pyridine and other heterocyclic derivatives, phosphonium or sulfonium compounds, etc.; anionic surface active agents containing acid groups such as carboxylic acids, sulfonic acids, phosphoric acids, sulfuric acid esters or phosphoric acid esters, etc.; and ampholytic surface active agents such as amino acids, aminosulfonic acids or sulfuric or phosphoric acid esters of aminoalcohols, etc. Further, fluorine containing surface active agents can be used together.

Further, the photographic light-sensitive materials of the present invention may contain alkyl acrylate type latexes as described in U.S. Pat. Nos. 3,411,911 and 3,411,912 and Japanese Patent Publication No. 5331/70 in the photographic layers.

In the following, the present invention is illustrated with reference to the example but the present invention is not limited to the example.

EXAMPLE

(1) Preparation of Samples

To a polyethylene terephthalate film base having a thickness of 180μ which was subjected to undercoating, a silver halide emulsion layer having the following composition was applied and a protective layer having the following composition was applied to said silver halide emulsion layer and dried to prepare black-and-white silver halide light-sensitive materials. To the protective layer, a nonionic surface active agent of the present invention or a surface active agent for comparison was added.

| | |
|---|---|
| Emulsion Layer | |
| Thickness: about 5μ | |
| Composition and coating amount: | |
| Gelatin | 2.5 g/m$^2$ |
| Silver iodobromide (silver iodide: 1.5% by mol) | 5 g/m$^2$ |
| 1-Phenyl-5-mercaptotetrazole | 25 mg/m$^2$ |
| Protective Layer | |
| Thickness: about μ | |
| Composition and coating amount: | |
| Gelatin | 1.7 g/m$^2$ |
| 2,6-Dichloro-6-hydroxy-1,3,5-triazine sodium salt | 10 mg/m$^2$ |
| Sodium N—oleyl-N—methyltaurate | 7 mg/m$^2$ |
| Nonionic surface active agent of the present invention or nonionic surface active agent for comparison | 40 mg/m$^2$ |

(2) Method of Determining Antistatic Property

The antistatic property was determined by measuring surface resistivity and generation of static mark.

Measurement of the surface resistivity was carried out by putting a test strip of the sample between brass electrodes (using stainless steel in the part contacting with the test strip) having a length of 10 cm with a space between electrodes of 0.14 cm and measuring a 1 minute value by means of an insulation tester: Type TR 8651 produced by Takeda Riken Co.

The static mark generation test was carried out by a method which comprises putting an unexposed sensitive material on a rubber sheet so that the surface containing the antistatic agent faced to the rubber sheet, pressing the sensitive material by a rubber roll, and separating it to generate static marks.

The surface resistivity was measured at 25° C. and 25% RH and the static mark generation test was carried out at 25° C. and 25% RH. Conditioning of the test strips of the sample was carried out under the above-described condition for a whole day and night.

In order to evaluate the degree of generation of static marks, each sample was developed at 20° C. for 5 minutes with a developing solution having the following composition.

| Composition of Developing Solution: | |
|---|---|
| N—Methyl-p-aminophenol sulfate | 4 g |
| Anhydrous sodium sulfite | 60 g |
| Hydroquinone | 10 g |
| Sodium carbonate (monohydrate) | 53 g |
| Potassium bromide | 25 g |
| Water to make | 1 liter |

Evaluation of the static mark was carried out according to the following standard consisting of five stages classified with respect to the rate of area of portions exposed with electric discharge.

A: less than 1%
B: from 1 to 10%
C: from 11 to 30%
D: from 31 to 50%
E: more than 50%

(3) Method of Testing Deterioration with Passage of Time

After the above-described samples and high quality white paper were conditioned at 25° C. and 70% RH for 1 hour, the high quality paper was put between two samples so that both sides of the high quality paper came into contact with the surface of the emulsion layer side of the samples, and they were put in a polyethylene laminated bag and sealed. These samples were allowed to stand at 25° C. for 1 week with applying a weight of 50 g/cm$^2$. Thereafter, the antistatic property was measured according to the above-described method of determining antistatic property and it was compared with that before the passage of time.

(4) Method of Testing Photographic Properties

After the above-described sample was exposed to light by a tungsten lamp through a filter SP-14 produced by Fuji Photo Film Co., it was developed with a developing solution having the following composition (at 35° C. for 30 seconds), fixed and washed. Then, photographic properties were examined.

| Composition of Developing Solution: | |
|---|---|
| Hot water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml |

(5) Measurement of Degree of Screen Contamination

Test strips and a screen LT-II produced by Dainippon Toryo Co. were conditioned at 30° C. and 80% RH for 1 day. After 1,000 test strips were allowed to pass in a cassette using LT-II under the same condition, photographing was carried out with X-rays and degree of uneven density was examined.

Evaluation of the degree of screen contamination was carried out according to the following standard consisting of four stages.

A: Generation of uneven density was not observed.
B: Uneven density was slightly generated.
C: Uneven density was considerably generated.
D: Uneven density was remarkably generated.

Results of each test (2) to (5) are shown in Table 1.

TABLE 1

| | | Antistatic Property | | | | | |
|---|---|---|---|---|---|---|---|
| | | Before Passage of Time | | After Passage of Time | | Photographic | |
| Sample No. | Antistatic Agent | Surface Resistivity (Ω) | Static Mark | Surface Resistivity (Ω) | Static Mark | Sensitivity (relative value) | Degree of Screen Contamination |
| 1 | Compound 1 (Invention) | $2.3 \times 10^{11}$ | A | $2.7 \times 10^{11}$ | A | 98 | A |
| 2 | Compound 2 (Invention) | $4.1 \times 10^{11}$ | A | $4.5 \times 10^{11}$ | A | 99 | A–B |
| 3 | Compound 3 (Invention) | $5.5 \times 10^{11}$ | A | $6.2 \times 10^{11}$ | A | 98 | A |
| 4 | Compound 4 (Invention) | $3.9 \times 10^{11}$ | A | $3.8 \times 10^{11}$ | A | 97 | A |
| 5 | Compound 8 (Invention) | $4.3 \times 10^{11}$ | A | $5.1 \times 10^{11}$ | A | 95 | A–B |
| 6 | Compound 14 (Invention) | $1.9 \times 10^{11}$ | A | $2.2 \times 10^{11}$ | A | 100 | A–B |
| 7 | Compound 15 (Invention) | $3.3 \times 10^{11}$ | A | $4.0 \times 10^{11}$ | A | 100 | A |
| 8 | Compound 21 (Invention) | $4.0 \times 10^{11}$ | A | $5.0 \times 10^{11}$ | A | 96 | A |
| 9 | Comparative Compound A | $4.1 \times 10^{11}$ | A | $9.5 \times 10^{13}$ | D | 80 | D |
| 10 | Comparative Compound B | $2.7 \times 10^{11}$ | A | $7.5 \times 10^{13}$ | D | 75 | D |
| 11 | Comparative Compound C | $5.0 \times 10^{11}$ | A | $8.8 \times 10^{12}$ | C | 89 | C |
| 12 | Mixture of Compound 1 of the present invention and Comparative Compound B (mixing ratio 2:1) | $3.8 \times 10^{11}$ | A | $7.9 \times 10^{12}$ | C | 87 | C |
| 13 | Blank | $7.4 \times 10^{14}$ | E | $8.1 \times 10^{14}$ | E | 100 | A |

Comparative Compound A $n\text{-}C_{12}H_{25}O\text{-}(CH_2CH_2O)_{10}\text{-}H$ (British Patent 861,134)

Comparative Compound B

TABLE 1-continued

| Sample No. | Antistatic Agent | Antistatic Property: Before Passage of Time, Surface Resistivity (Ω) | Before Passage of Time, Static Mark | After Passage of Time, Surface Resistivity (Ω) | After Passage of Time, Static Mark | Photographic Sensitivity (relative value) | Degree of Screen Contamination |
|---|---|---|---|---|---|---|---|
| | 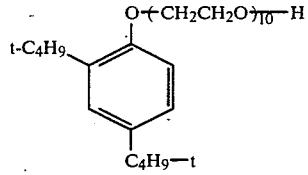 Comparative Compound C 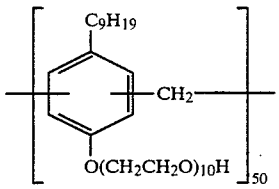 (Compound I-3 of U.S. Pat. No. 3,850,641) | | | | | | |

Table 1 clearly shows that in photographic light-sensitive materials containing the compound having two polyoxyethylene chains in the molecule of the present invention, the surface resistivity is sufficiently low, static marks are hardly observed, the photographic sensitivity is hardly reduced, and the screen contamination property is excellent. Further, this excellent antistatic property hardly changes with the passage of time.

On the other hand, in case of Comparative Compounds A and B which have one polyoxyethylene chain in the molecule, the antistatic property before the passage of time is excellent, but it deteriorates with the passage of time. Further, they remarkably deteriorate the photographic sensitivity and the screen contamination property.

Further, in case of Comparative Compound C which is an ethylene oxide addition polymer of phenol-formaldehyde resin, it is inevitable that the antistatic property deteriorates with the passage of time, the photographic sensitivity is reduced and the screen contamination property deteriorates.

Furthermore, when Compound 1 having two polyoxyethylene chains in the molecule of the present invention is used together with Comparative Compound B havine one polyoxyethylene chain in the molecule as a mixture, it is observed that the antistatic property deteriorates with the passage of time, the photographic sensitivity is reduced and the screen contamination property deteriorates. Thus, it is understood that compounds having one polyoxyethylene chain in the molecule cause remarkable deterioration of properties, when they are used alone or as a mixture, and that compounds of the present invention which can be synthesized without containing compounds having one polyoxyethylene chain in the molecule show excellent properties which cannot be attained in ethylene oxide addition polymers of phenol-formaldehyde resin.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support base having thereon a silver halide emulsion layer; and an antistatic layer which contains a nonionic surface active agent in an amount of 5–500 mg per $m^2$ having two polyoxyethylene chains in a molecule, the agent being represented by the formula (I):

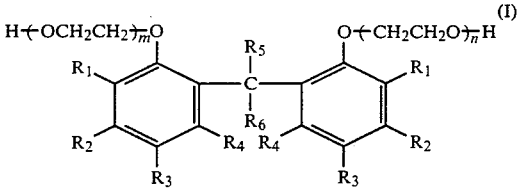

(I)

wherein $R_1$ and $R_3$ each represents a substituted or non-substituted alkyl, aryl, alkoxy, aryloxy, acyl, amido, sulfonamido, carbamoyl or sulfamoyl group, or a halogen atom, $R_2$ and $R_4$ each represents a hydrogen atom, a substituted or nonsubstituted alkyl, aryl, alkoxy, aryloxy, acyl, amido, sulfonamido, carbamoyl or sulfamoyl group, or a halogen atom, $R_5$ and $R_6$ each represents a hydrogen atom, or a substituted or nonsubstituted alkyl or aryl group, wherein the sum total of carbon atoms in $R_5$ and $R_6$ is 2 or more, or $R_5$ and $R_6$ may form a ring by linking with each other, and m and n independently represent an average degree of polymerization of ethylene oxide which is 2 to 40.

2. A silver halide photographic light-sensitive material as claimed in claim 1, wherein the antistatic layer is the outermost layer of the material.

3. A photographic light-sensitive material as claimed in claim 1, wherein the antistatic layer is a protective layer.

4. A photographic light-sensitive material as claimed in claim 1, wherein $R_1$ and $R_3$ independently represent an alkyl group.

5. A photographic light-sensitive material as claimed in claim 4, wherein $R_1$ is selected from the group consisting of a t-butyl group, a t-amyl group, a t-hexyl group and a t-octyl group.

6. A photographic light-sensitive material as claimed in claim 1, wherein $R_2$ and $R_4$ are each a hydrogen atom.

7. A photographic light-sensitive material as claimed in claim 1, wherein $R_6$ is a hydrogen atom.

8. A photographic light-sensitive material as claimed in claim 1, wherein $R_6$ is an alkyl group containing 1 to 8 carbon atoms or a phenyl group.

9. A photographic light-sensitive material as claimed in claim 7, wherein $R_5$ is an alkyl group containing 2 to 8 carbon atoms or a phenyl group.

10. A photographic light-sensitive material as claimed in claim 7, wherein $R_5$ is a group selected from the group consisting of an ethyl group, an n-propyl group, an i-propyl group and a phenyl group.

11. A photographic light-sensitive material as claimed in claim 8, wherein $R_5$ is an alkyl group containing 1 to 8 carbon atoms or a phenyl group.

12. A photographic light-sensitive material as claimed in claim 1, wherein m and n independently represent an average degree of polymerization of ethylene oxide which is 7 to 40.

13. A photographic light-sensitive material as claimed in claim 12, wherein the amount of the anionic surface active agent is 20 to 200 mg per $m^2$.

* * * * *